US005341518A

United States Patent [19]

Uhl

[11] Patent Number: 5,341,518

[45] Date of Patent: Aug. 30, 1994

[54] COMMODE SEAT LIFT APPARATUS

[76] Inventor: James R. Uhl, Scharf & Frazee Ave., Box 59, Vergas, Minn. 56587

[21] Appl. No.: 84,927

[22] Filed: Jul. 1, 1993

[51] Int. Cl.[5] ..... A47K 13/10; A47K 13/12

[52] U.S. Cl. ..... 4/236; 4/241

[58] Field of Search ..... 4/236, 240, 241, 246.1

[56] References Cited

U.S. PATENT DOCUMENTS

| | | | |
|---|---|---|---|
| 905,996 | 12/1908 | Davis | 4/241 |
| 1,128,629 | 2/1915 | Schwab | 4/241 |
| 2,629,881 | 3/1953 | Young | 4/240 |
| 3,653,077 | 4/1972 | Warnberg | 4/236 |
| 4,426,743 | 1/1984 | Seabrooke | 4/241 X |
| 4,780,914 | 11/1988 | Lin | 4/236 |

*Primary Examiner*—Robert M. Fetsuga

*Attorney, Agent, or Firm*—E. Michael Combs

[57] ABSTRACT

A commode seat and lift structure include a central axle directed therethrough, with a pair of springs interposed between the commode seat and commode to effect biasing of the seat in a lifting orientation relative to the commode. The springs each include an adjuster plate and an adjuster rod threaded through the plate. The adjuster rod includes a mounting plate secured to the commode bowl to adjust the spring force.

2 Claims, 3 Drawing Sheets

COMMODE SEAT LIFT APPARATUS

BACKGROUND OF THE INVENTION

1. Field of the Invention

The field of invention relates to commode seat lift structure, and more particularly pertains to a new and improved commode seat lift apparatus wherein the same is directed to the lifting of a commode seat relative to an associated commode structure.

2. Description of the Prior Art

Commode seat lift structure has been indicated in the prior art and exemplified by the U.S. Pat. Nos. 4,951,324; 4,853,983; 4,780,914; and 4,470,161.

The instant invention attempts to overcome deficiencies of the prior art by providing for a simplified and effective commode seat lift structure to provide for automatic lifting of a commode seat relative to an associated commode structure and in this respect, the present invention substantially fulfills this need.

SUMMARY OF THE INVENTION

In view of the foregoing disadvantages inherent in the known types of commode sat lift apparatus now present in the prior art, the present invention provides a commode seat lift apparatus including biasing springs to effect lifting of a commode seat relative to a commode structure. As such, the general purpose of the present invention, which will be described subsequently in greater detail, is to provide a new and improved commode seat lift apparatus which has all the advantages of the prior art commode seat lift apparatus and none of the disadvantages.

The attain this, the present invention provides a commode seat and lift structure including a central axle directed therethrough, with a spring interposed between the commode seat and commode to effect biasing of the seat in a lifting orientation relative to the commode.

My invention resides not in any one of these features per se, but rather int he particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved commode seat lift apparatus which has all the advantages of the prior art commode seat lift apparatus and one of the disadvantages.

It is another object of the present invention to provide a new and improved commode seat lift apparatus which may be easily and efficiently manufactured and marketed.

It is a further object of the present invention to provide a new and improved commode seat lift apparatus which is of a durable and reliable construction.

An even further object of the present invention is to provide a new and improved commode seat lift apparatus which is susceptible of a low cost of manufacture with regard to both materials and labor, and which accordingly is then susceptible of low prices of sale to the consuming public, thereby making such commode seat lift apparatus economically available to the buying public.

Still yet another object of the present invention is to provide a new and improved commode seat lift apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference would be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
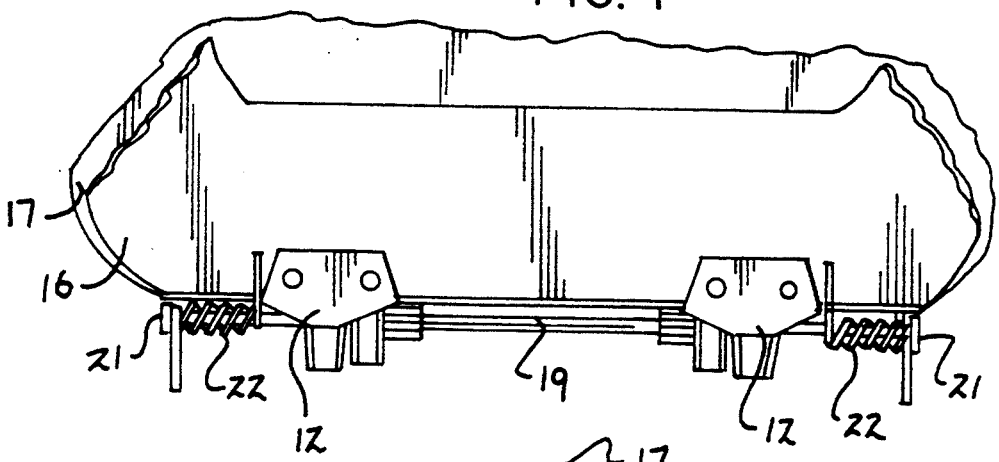
FIG. 1 is an orthographic view of the commode seat structure, including spring members interposed between the commode seat and an underlying commode structure.
Figure 2:
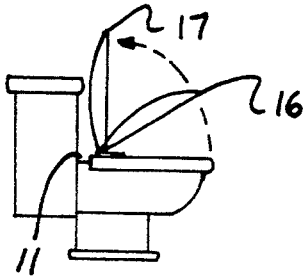
FIG. 2 is an orthographic side view of the commode seat arranged for lifting relative to the commode top wall surface.
Figure 3:
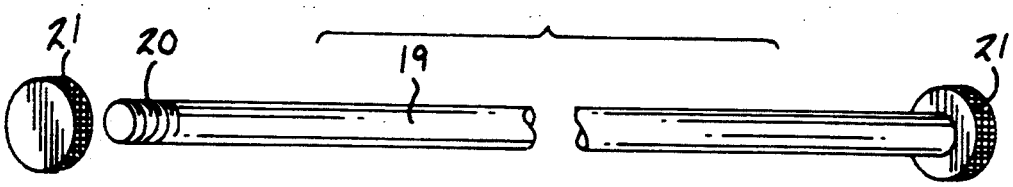
FIG. 3 is an isometric illustration of the axle structure employed by the invention.
Figure 4:
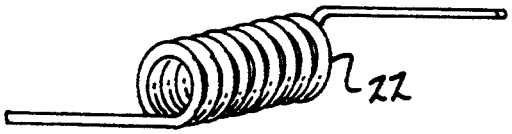
FIG. 4 and FIG. 5 are isometric illustrations of the spring members employed by the invention.
Figure 5:
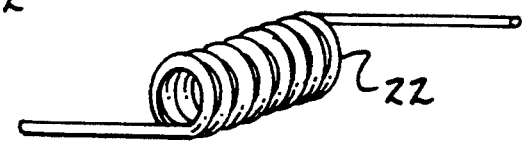
Figure 6:
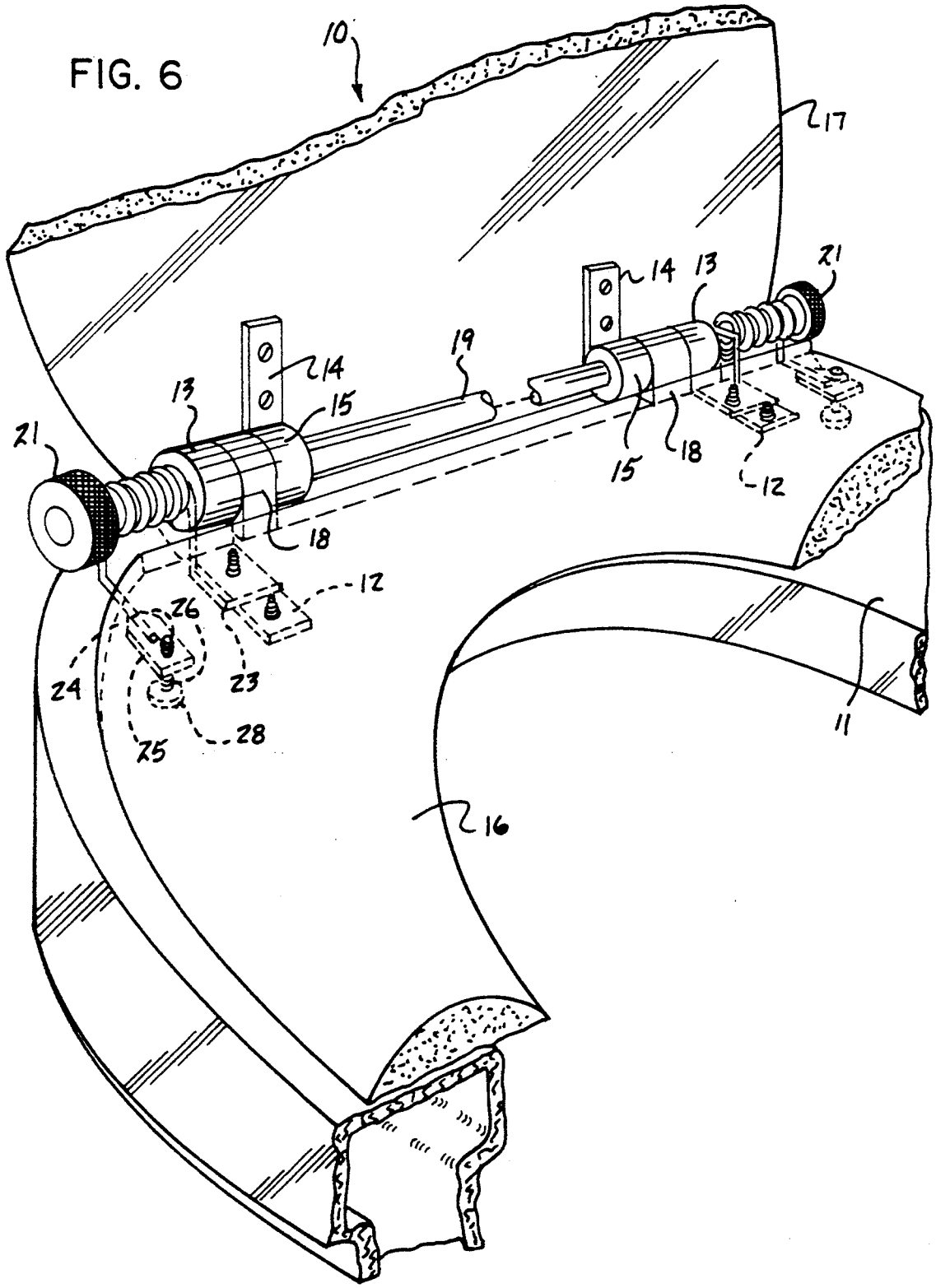
FIG. 6 is an isometric view of the invention mounted to a commode in a partial sectional view.

With reference now to the drawings, and in particular to FIGS. 1 to 8 thereof, a new and improved commode seat lift apparatus embodying the principles and concepts of the present invention and generally designated by the reference numeral 10 will be described.

Figure 7:
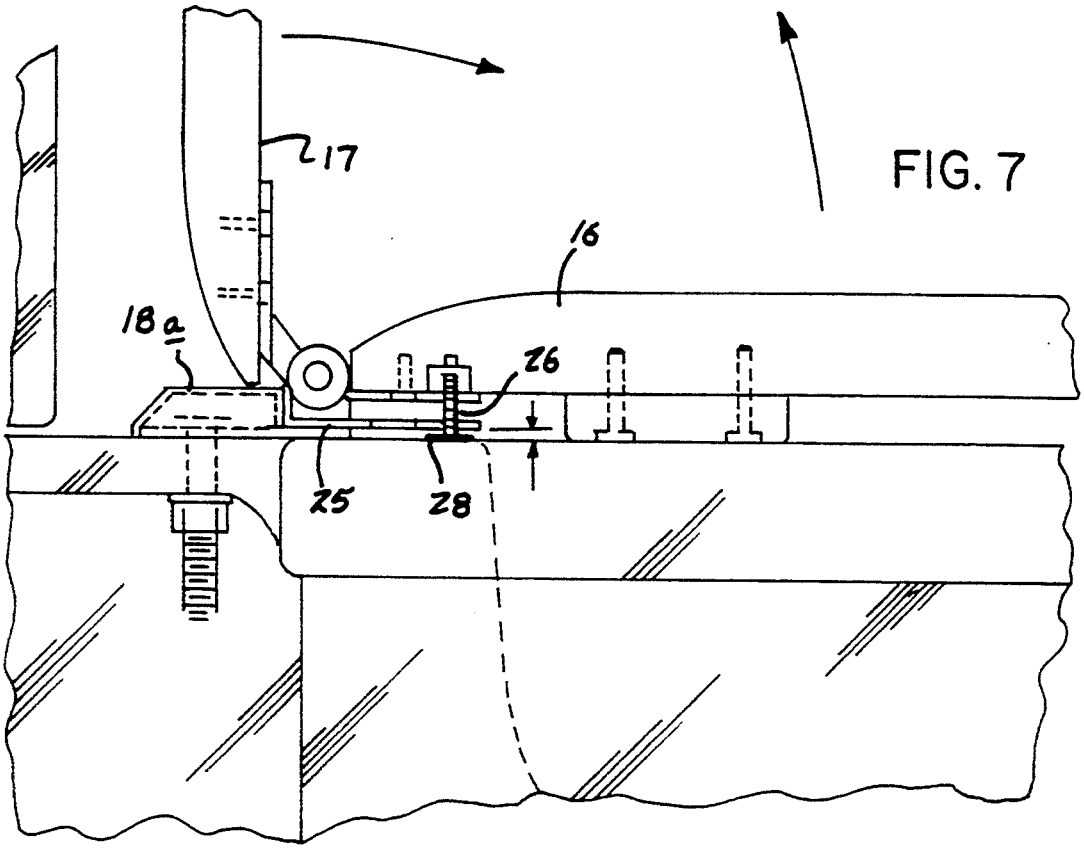
FIG. 7 is an orthographic side view of the adjuster structure employed by the invention.
Figure 8:
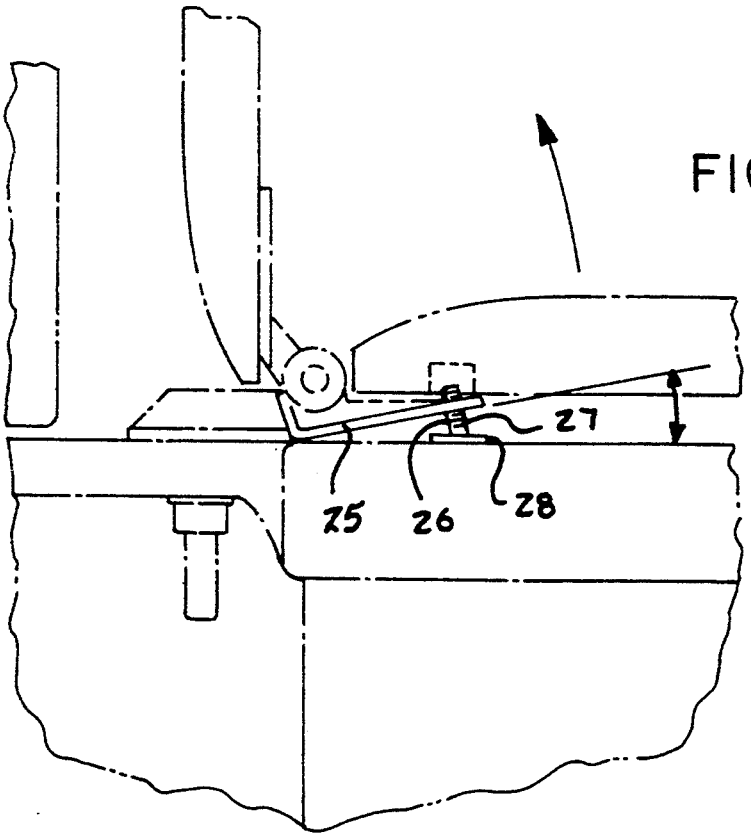
FIG. 8 is an orthographic side view of the adjuster structure arranged to effect lifting and adjusting of the spring tension of the organization.

More specifically, the commode seat lift apparatus 10 of the instant invention essentially comprises (see FIG. 6) a commode bowl top wall 11 of an associated commode bowl, including a plurality of spaced first hinge plates 12 mounted to an associated commode seat 16, with the first hinge plates 12 having a first hinge tube 13. A second hinge plate 14 mounted to an associated commode lid 17 is positioned in a spaced relationship relative to each of the first hinge plates 12, with each second hinge plate 14 having a second hinge tube 15. A central hinge tube 18 includes a central hinge tube mounting plate 18*a* fixedly secured to the commode bowl top wall 11, in a manner as indicated in FIG. 7 for example. Each grouping of the respective first hinge tube, second hinge tube, and central hinge tube are coaxially aligned, with each grouping coaxially aligned relative to one another, such that an axle shaft 19 is directed through each grouping formed of the respective first hinge tube 13, second hinge tube 15, and central hinge tube 18. The axle shaft 19 includes threaded shaft ends 20 mounting an end cap 21 threaded mounted upon the threaded shaft end 20 to capture a lift spring 22 between each grouping of hinge tubes and a respective end cap 21 providing ease of replacement and servicing of the lift springs. Each lift spring 22 includes a spring first end 23 secured to a respective first hinge plate 12, with a spring second end 24 mounted to an adjuster plate 25. Each adjuster plate 25 (see FIGS. 6–8) includes an adjuster rod 26 threadedly directed through said adjuster plate 25. The adjuster road 26 includes an adjuster rod head 27 rotatably secured to a mounting plate 28, that in turn is secured to the commode blow top wall 11. Rotation of the adjuster rod 26 effects lifting and lowering of the adjuster plate 25 to effect adjustment of spring tension upon a respective lift spring 22.

As to the manner of usage and operation of the instant invention, the same should be apparent from the above disclosure, and accordingly no further discussion relative to the manner of usage and operation of the instant invention shall be provided.

With respect tot he above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described int he specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A commode seat lift apparatus, comprising, a commode bowl, having a commode bowl top wall, including a commode seat and a commode lid, and a plurality of spaced first hinge plates mounted to the commode seat, with each of the first hinge plates including a first hinge tube, and a plurality of second hinge plates, wherein one of said second hinge plates is mounted in spaced adjacency to one of said first hinge plates, and the second hinge plates are secured to said commode lid, wherein each of the second hinge plates includes a second hinge tube, wherein one said second hinge tube is positioned in spaced adjacency to one said first hinge tube, and a plurality of central hinge tubes, wherein one of said central hinge tubes is positioned interposed between one of said first hinge tubes and one of said second hinge tubes, wherein one first hinge tube, one second hinge tube, and one central hinge tube defines a tube group, and each tube group is coaxially aligned with an axle shaft directed through each tube group, and a plurality of lift springs, with an individual lift spring positioned in adjacency to each tube group, each lift spring including a spring first end secured to one of said first hinge plates and a spring second end arranged for biasing relative to the commode bowl top wall, and each spring second end includes an adjuster plate securing said spring second end, each adjuster plate includes an adjuster rod threadedly directed therethrough, each adjuster rod includes an adjuster rod head and a mounting plate rotatably securing each adjuster rod head, with the mounting plate fixedly secured to the commode bowl top wall.

2. An apparatus as set forth in claim 1 wherein the axle shaft includes a plurality of axle shaft threaded ends, with an end cap mounted to each threaded end of said axle shaft threaded ends, and each of said lift springs interposed between one of said tube groups and a respective end cap.

* * * * *